United States Patent [19]

Kirman et al.

[11] 4,170,525

[45] Oct. 9, 1979

[54] PROCESS FOR PLATING A COMPOSITE STRUCTURE

[75] Inventors: Lyle E. Kirman, Cleveland Heights; Wayne A. Kruper, Willowick, both of Ohio

[73] Assignee: Gould Inc., Rolling Meadows, Ill.

[21] Appl. No.: 900,953

[22] Filed: Apr. 28, 1978

[51] Int. Cl.[2] ..... C25D 5/36; C25D 5/44

[52] U.S. Cl. ..... 204/23; 204/33; 204/34

[58] Field of Search ..... 204/23, 25, 33, 34, 204/248, 249

[56] References Cited

U.S. PATENT DOCUMENTS

| | | | |
|---|---|---|---|
| 2,624,684 | 1/1953 | Heiman | 427/328 |
| 2,734,024 | 2/1956 | Schultz | 204/23 |
| 2,766,195 | 10/1956 | Combs et al. | 204/23 |
| 3,108,006 | 10/1963 | Kenedi et al. | 204/33 |
| 3,594,197 | 7/1971 | Bunevich et al. | 106/1.25 |
| 3,616,291 | 10/1971 | Wilson | 204/27 |
| 3,689,292 | 9/1972 | Preston | 427/353 |
| 3,726,771 | 10/1973 | Coll-Palagos | 204/33 |
| 3,867,265 | 2/1975 | Hansson | 204/33 |
| 3,917,486 | 11/1975 | Schneble | 106/1.25 |
| 4,013,492 | 3/1977 | Rager et al. | 204/33 |

*Primary Examiner*—T. M. Tufariello

*Attorney, Agent, or Firm*—Russell E. Baumann; Edward E. Sachs

[57] ABSTRACT

A process is provided for plating a composite structure which includes one surface composed of an aluminum base metal and another surface composed of a ferrous base metal with a thin adherent layer of tin or an alloy of tin. The process comprises contacting the composite structure with a mineral acid containing a source of ions selected from the group consisting of fluoride ions, fluoride containing ions or mixtures thereof to activate the surface of the aluminum base metal and then immersing the composite structure in an aqueous plating bath which contains a mineral acid, a source of ions selected from the group consisting of fluoride ions, fluoride containing ions or mixtures thereof and a source of stannous ions with the stannous ions being present in an amount ranging from about 1 to about 75 grams per liter, for a period of time sufficient to cause tin or tin alloy to be deposited concurrently on the aluminum base metal surface by the exchange of aluminum ions for tin ions and on the ferrous base surface by means of a galvanic couple formed between the aluminum base metal and the ferrous base metal.

15 Claims, No Drawings

PROCESS FOR PLATING A COMPOSITE STRUCTURE

BACKGROUND OF THE INVENTION

A. Field of the Invention

This invention relates to a process for applying a thin coating or layer of tin or tin alloy on a composite structure which has one surface composed of an aluminum base metal (i.e., aluminum or an alloy of aluminum) and another surface composed of a ferrous base metal) (i.e., iron or an alloy of iron). More specifically, it concerns a method of concurrently applying a layer or coating of tin or a tin alloy on the exposed surface of a bearing structure which includes a steel substrate which carries or supports an aluminum base metal bearing surface by treating the surface of the bearing with a mineral acid containing either fluoride ions, fluoride containing ions or mixtures thereof and then immersing the bearing in an aqueous plating bath containing a mineral acid, a source of either fluoride ions, fluoride containing ions or mixtures thereof and a source of stannous ions with the stannous ions being present in an amount ranging from about 1 to about 75 grams per liter.

B. Description of the Prior Art

The deposition of a thin coating or plating of tin on the surface of bearings composed of aluminum or aluminum alloys in order to impart a pleasing appearance thereto or to provide corrosion protection therefore, or to provide a "run-in" surface thereon is well known in the art.

Specifically, it is common practice to apply a thin coating of tin to the surface of a bearing by means of electrodeposition to achieve such results. While this technique has met with success, there are certain inherent disadvantages associated therewith. For example, an electrical power source must be provided and the parts must be properly oriented in the plating bath in order to obtain a satisfactory deposit thereon. In addition, an electrodeposition technique also suffers from the fact that it is difficult to apply thin layers of metal to a structure having a complicated surface configuration. Accordingly, while this technique finds use as a means of applying a thin layer of tin to the surface of a bearing structure it suffers from certain inherent limitations.

Another well known technique for coating the surface of a bearing with tin is the so-called immersion plating process. In this process, metal is deposited from its salt on the surface of the bearing without the aid of an outside source of electrical current or of chemical reducing agents. This process is especially appealing in that thin coatings of uniform thickness can be readily applied to a structure having a complicated surface configuration. Immersion tin plating baths are either alkaline or acidic. While both types of baths can be used to deposit tin on the surface of aluminum or aluminum alloy, none of the heretofore known baths can be used to satisfactorily apply a thin tin coating to a composite structure having one surface composed of an aluminum base metal and another surface composed of a ferrous base metal. Specifically, alkaline tin immersion baths do not coat both the aluminum and ferrous base metals, but only the aluminum base metal. In addition, the adhesion of tin to the aluminum base metal is generally poor and tends to blister and peel. Various immersion acid tin plating baths have been used quite successfully to deposit a thin layer of tin on a structure which is all aluminum or an alloy thereof, however, when such plating baths are employed to apply a thin layer of tin to a composite structure having a surface composed of an aluminum base metal and another surface composed of a ferrous base metal, the tin deposit so obtained does not exhibit good adhesion to both metal surfaces. To overcome this problem, it is known in the art to apply tin to the surface of the aluminum base metal by immersion plating techniques and to apply tin to the ferrous base metal surface by electrodeposition. Obviously, this procedure is quite involved and is to be avoided, if possible.

Another well known technique for depositing a thin layer of tin on a surface is the so-called contact plating technique. In this technique, the article to be tinned is usually in direct contact with a piece of tin or zinc in the solution. The contact process is in effect an electrolytic method, with the outside source of currents being replaced by a galvanic couple. However, when conventional contact plating baths are utilized to apply tin to a composite structure having a ferrous base metal surface and an aluminum base metal surface, the coating obtained on the aluminum base metal surface is generally of a very poor quality. This is due to the fact that conventional contact plating baths are designed to produce the desired coating on only the more noble metals.

In order to overcome or at least significantly minimize the hereinbefore discussed difficulties applicants have developed a unique plating process which will be described hereinafter in more detail.

SUMMARY OF THE INVENTION

The present invention concerns a method for applying a thin coating of tin or tin alloy to the surface of a composite structure having one surface thereof composed essentially of an aluminum base metal and another surface thereof composed essentially of a ferrous base metal. More particularly, the present invention is directed to a method for concurrently coating the surface of a composite bearing structure having one portion of the surface area thereof composed of an aluminum base metal and another portion of the surface area thereof composed essentially of a ferrous base metal with an adherent layer of a tin base metal (i.e., tin or an alloy of tin) comprising contacting the composite structure with a mineral acid containing either fluoride ions, fluoride containing ions or mixtures thereof to activate the surface of the aluminum base metal and subsequently immersing the so-treated composite structure in an aqueous bath containing a mineral acid, a source of either fluoride ions, fluoride containing ions or mixtures thereof and a source of stannous ions with the stannous ions being present in an amount ranging from about 1 to about 75 grams per liter for a period of time sufficient to cause the tin to be deposited concurrently on the aluminum base metal surface by the exchange of aluminum ions for tin ions and on the ferrous base metal surface by means of a galvanic couple formed between the aluminum base metal and the ferrous base metal.

The present invention provides a unique method for applying a thin layer of tin to a bearing structure which includes a steel substrate and an aluminum or an aluminum alloy bearing surface. In this process, it is essential that the composite bearing structure first be contacted with a mineral acid which contains either fluoride ions or fluoride containing ions or mixtures thereof to activate the surface of the aluminum or aluminum alloy. The plating bath utilized must contain a mineral acid, a source of either fluoride ions or fluoride containing ions or mixtures thereof and a source of stannous ions with the stannous ions being present in the bath in an amount ranging from about 1 to 75 grams per liter. When the concentration of stannous ions is maintained within the hereinbefore set forth range, the exposed steel surface will receive a continuous adherent coating of tin which is 10–30 millionths of an inch thick, while the aluminum or aluminum alloy surface will receive an adherent tin deposit approximately twice this thickness. The stannous ion concentration is the most critical feature of the process of the subject invention. If it is to high, the tin plate on the aluminum or aluminum alloy surface will be of an increased thickness, the adhesion of the tin to the aluminum or aluminum alloy will be exceptionally high, and the thickness and coverage of the tin on the steel will be decreased to a dangerously low point. Conversely, if the stannous concentration is to low, the adhesion of tin on the aluminum or aluminum alloy material will be poor and course, grained tin deposits will be obtained. Accordingly, it is apparent that in order to obtain a thin coating of tin on a composite bearing structure by the technique of the instant invention one must carefully control the stannous ion concentration of the plating bath.

DESCRIPTION OF THE PREFERRED EMBODIMENTS OF THE INVENTION

The technique of the present invention is used to produce a thin, adherent coating of tin or alloys of tin with other metals, particularly cadmium, zinc and lead on a composite article composed of aluminum or an aluminum alloy and another metal more noble than aluminum, particularly iron to enhance its appearance or to provide it with corrosion protection. Typical of such composite articles are composite bearings of the type described in U.S. Pat. No. 4,069,369, which has a common assignee, and which is incorporated herein by reference.

Broadly, the method of the present invention requires the following minimum steps:

(a) treating or contacting the composite bearing structure with a mineral acid which contains either fluoride ions, fluoride containing ions or mixtures thereof to activate the surface of the aluminum base metal; and (b) positioning or immersing the so-treated composite bearing structure in an aqueous bath which contains a mineral acid, a source of either fluoride ions, fluoride containing ions or mixtures thereof and a source of stannous ions with the stannous ions being present in an amount ranging from about 1 to about 75 grams per liter for a period of time sufficient to cause tin to be deposited on the exposed surface of the composite bearing structure.

In the preferred practice of the subject invention, additional processing steps are employed. A typical process sequence used to apply a thin layer of tin to a bearing structure (of the type described in U.S. Pat. No. 4,069,369) having a steel substrate and an aluminum base bearing layer thereon is as follows:

(a) vapor degrease the surface of the bearing in a chlorinated hydrocarbon solvent, such as perchloroethylene, (b) further clean the bearing structure in an aqueous alkaline solution, such as an aqueous solution of $Na_3PO_4$ and $Na_2CO_3$, (c) water rinse the so-cleaned article, (d) soak the bearing structure in an aqueous solution of an acid, such as 10% sulfuric acid, at an elevated temperature, for example 140° F., to remove oxides which may be present on the steel substrate, (e) water rinse the so-treated article, (f) contact the bearing structure with an aqueous solution of a mineral acid containing either fluoride ions, fluoride containing ions or mixtures thereof, such as a 5% hydrofluoric acid, to activate the aluminum base bearing layer, (g) rinse the activated structure, (h) immerse the bearing structure in an aqueous plating bath containing a mineral acid, a source of either fluoride ions, fluoride containing ions or mixtures thereof and a source of stannous ions with the stannous ions being present in an amount ranging from about 1 to about 75 grams per liter for a period of time sufficient to cause tin to be deposited on the exposed surface of the bearing structure, and (i) remove the article from the plating bath and rinse the same.

In certain circumstances, the tin plated article is then immersed in an aqueous solution of $Na_2Cr_2O_7$ in order to deposit a layer of chromate on the tin to render the plated structure fingerprint resistant.

The foregoing description is general in nature and dependent upon the particular composition of the article being treated some changes therein may be effected. For example, with some aluminum alloys a desmutting solution such as 1:1 nitric acid or a chromate acid-sulfuric acid mixture may be employed. In addition, with certain aluminum alloys, a dip in a solution of wetting agent immediately before immersing it in the plating bath produces improved adhesion. As before noted, the step of treating the tin plated article with a chromium containing solution can be eliminated.

As before noted, in the practice of the subject invention it is essential that the composite bearing structure must be treated with a mineral acid which contains either fluoride ions, fluoride containing ions or mixtures thereof to activate the surface of the aluminum base metal. Typical acids used for this purpose are hydrofluoric acid and fluoboric acid. Other mineral acids which contain fluoride ions, fluoride containing ions or mixtures thereof may also be employed but the before listed acids have been found to be especially efficient. The duration of the contacting of the article with the mineral acid can be varied. All that is required is that the article be contacted with the mineral acid for a sufficient period of time to activate the aluminum base metal so that tin can be adherently deposited thereon.

The plating bath used in practice of the subject invention can contain any of the below listed ingredients within the specified ranges. The following represents the composition of a typical bath utilized in connection with the practice of the subject invention where the desired coating is pure tin:

0 to 30 g/l boric acid,
0 to 150 g/l hydrofluoric acid,
0 to 150 g/l sulfuric acid,
0 to 150 g/l fluoboric acid,
1 to 75 g/l stannous tin,
0 to 8 g/l antioxidant,
if used, greater than 0.1 g/l non-ionic surfactant
0–0.5 g/l grain refiner
greater than 1.0 g/l fluoride ions, or fluoride containing ions, or mixtures thereof.

If it is desired to deposit a tin-cadmium alloy layer on the bearing structure, the above bath may contain up to 75 g/l of cadmium ions. Likewise, if it is desired to deposit a tin-lead alloy, the bath may contain up to 75 g/l of lead ions. However, in this latter case the bath should not contain any sulfate. Also, if it is desired to deposit a tin-zinc alloy the bath may contain up to 75 g/l of zinc ions.

A typical bath for plating a tin-zinc alloy is as follows:
0 to 88 g/l sulfuric acid,
3 to 200 ml/l fluoboric acid,
0 to 8 g/l hydroquinone,
1.7 to 120 g/l sodium gluconate,
1 to 75 g/l stannous ions, and
1 to 75 g/l zinc oxide.

The pH of the bath is regulated so as to range from about 2.5 to slightly less than 7.

A typical bath for plating a tin-lead alloy is as follows:
3 to 200 g/l fluoboric acid,
1 to 75 g/l stannous ions,
0 to 8 g/l hydroquinone, and
1 to 75 g/l lead ions.

A typical bath for plating a tin-cadmium alloy is as follows:
0–85 g/l sulfuric acid,
3–90 g/l fluoboric acid,
0–8 g/l hydroquinone,
1–75 g/l stannous ions, and
0.1–75 g/l cadmium ions.

As hereinbefore noted, it is essential that the plating bath contain a mineral acid. In this regard, in the preferred practice of the subject invention, a minimum of 20 g/l of hydrofluoric acid, fluoboric acid or a combination of sulfuric and fluoboric and/or hydrofluoric acids are required for efficient operation. However, all that is actually required is that the plating bath be acidic in nature.

The requirement that the bath contain a source of either fluoride ions, fluoride containing ions or mixtures thereof can be met in various ways. The most practical way is for the bath to contain either hydrofluoric acid or fluoboric acid.

The stannous tin ions are supplied to the bath preferably as a soluble salt or solution, such as stannous sulfate or stannous fluoborate.

The antioxidants which may be used in the bath are of the aromatic hydroxy type. Examples of such compounds are resorcinol, hydroquinone, catechol, amino phenol, and other similar compounds. The function of the antioxidant is to slow the rate of oxidation of stannous tin to stannic tin. Stannic tin neither contributes to nor detracts from the use of a bath, however, the stannous tin concentration should be maintained within the above-identified range. In fact, the preferred range of stannous tin is from about 1 to about 35 g/l.

The non-ionic surfactants (wetting agents) used in the bath are preferably the reaction products of ethylene oxide and nonylphenol. However, other non-ionic surfactants which are compatible with the plating bath may also be utilized. Such surfactants or wetting agents are well known in the art and, therefore, will not be discussed herein in detail.

In addition, grain refiners, such as gelatin or hydrolysed glue may also be employed, but these materials are not essential to the operation of the bath.

Alloys of tin with metals such as cadmium, zinc and lead may be plated using the above-described type of bath by adding thereto a soluble salt of the alloy metal such as the sulfate, fluoborate, oxide or carbonate in an amount sufficient to produce a concentration ranging from about 0.1 to about 75 g/l of the alloy metal.

The duration of the immersion step varies with the type and thickness of metal or alloy coating to be deposited. In practice, satisfactory deposits have been obtained by employing baths of the type described herein with the immersion period ranging from 3 to 4 minutes at ambient temperature.

Typical examples of the practice of the subject application are as follows:

EXAMPLE 1

A bearing structure (of the type disclosed in U.S. Pat. No. 4,069,369) having a steel base or substrate and a bearing layer of aluminum alloy deposited thereon was coated with a thin layer of tin utilizing the following procedure:

(a) vapor degreasing with perchloroethylene;
(b) alkaline soak cleaned in an aqueous solution of 20 g/l $Na_3PO_4$ plus 20 g/l $Na_2CO_3$, for about 2 minutes;
(c) water rinse;
(d) soaked in an aqueous solution of 10% sulfuric acid at a temperature of 150° F. for about 3 minutes;
(e) water rinsed;
(f) soaked for a period of 0.5 minutes in an aqueous solution of 5% hydrofluoric acid;
(g) water rinsed;
(h) immersed for 3 minutes in a plating bath which contained 50–85 g/l sulfuric acid, 3–5 g/l fluoboric acid, 15–25 g/l stannous sulfate (8–13 g/l stannous tin), 3–5 g/l hydroquinone, and 1–2 g/l wetting agent (IGEPAL CO-880, TM of GAF Corp.);
(i) water rinsed;
(j) immersed in an aqueous solution of about 0.25 g/l of $Na_2Cr_2O_7$ at a temperature of about 170° F. for 0.5 minutes; and
(k) removed therefrom and dried.

The resulting structure was examined metallographically and found to have had an adherent coating of tin deposited over the entire surface thereof.

EXAMPLE 2

A composite bearing of the type described in EXAMPLE 1 above was coated with a thin layer of a tin-zinc alloy as follows:

(a) vapor degreasing with perchloroethylene;
(b) alkaline soak cleaned in an aqueous solution of 20 g/l $Na_3PO_4$ plus 20 g/l $Na_2CO_3$, for about 2 minutes;
(c) water rinse;
(d) soaked in an aqueous solution of 10% sulfuric acid at a temperature of 150° F. for about 3 minutes;
(e) water rinsed;
(f) soaked for a period of 0.5 minutes in an aqueous solution of 5% hydrofluoric acid;
(g) water rinsed;
(h) immersed for 3 minutes in a plating bath containing 80 ml/l fluoboric acid, 2 g/l surfactant, 4 g/l hydroquinone, 19 g/l sodium gluconate, 18 g/l stannous sulfate, 25 g/l $ZnO_2$ (as soluble zinc salt) with pH adjusted to about 3.5; and
(i) removed from bath and water rinsed.

The bearing structure coated as described above was examined metallographically and found to have a continuous adherent alloy surface coating of about 80% tin–20% zinc.

EXAMPLE 3

A composite bearing of the type described in EXAMPLE 1 was coated with a thin adherent layer of a tin-lead alloy as follows:

(a) vapor degreasing with perchloroethylene;

(b) alkaline soak cleaned in an aqueous solution of 20 g/l $Na_3PO_4$ plus 20 g/l $Na_2CO_3$, for about 2 minutes;

(c) water rinse;

(d) soaked in an aqueous solution of 10% sulfuric acid at a temperature of 150° F. for about 3 minutes;

(e) water rinsed;

(f) soaked for a period of 0.5 minutes in an aqueous solution of 5% hydrofluoric acid;

(g) water rinsed;

(h) immersed for 5 minutes in a plating bath containing 40 g/l fluoboric acid, 2 g/l stannous ions (as stannous fluoboric acid), 4 g/l hydroquinone, 18 g/l of lead ions (as lead fluoborate) and 2 g/l non-ionic wetting agent;

(i) removed from bath and water rinsed.

The bearing produced as described above was examined metallographically and found to be completely coated with a thin alloy layer of 12% tin–88% lead.

EXAMPLE 4

A bearing of the type described above in EXAMPLE 1 was coated with a surface layer of tin-cadmium alloy as follows:

(a) vapor degreasing with perchloroethylene;

(b) alkaline soak cleaned in an aqueous solution of 20 g/l $Na_3PO_4$ plus 20 g/l $Na_2CO_3$, for about 2 minutes;

(c) water rinse;

(d) soaked in an aqueous solution of 10% sulfuric acid at a temperature of 150° F. for about 3 minutes;

(e) water rinsed;

(f) soaked for a period of 0.5 minutes in an aqueous solution of 5% hydrofluoric acid;

(g) water rinsed;

(h) immersed for 3 minutes in a plating bath containing 75 ml/l sulfuric acid, 5 g/l fluoboric acid, 25 g/l stannous sulfate, 5 g/l cadmium fluoborate, 4 g/l hydroquinone, and 2 g/l non-ionic surfactant.

(i) removed from bath and water rinsed.

The so-coated bearing structure was examined metallographically and found to have an adherent alloy surface coating consisting of about 95% tin–5% cadmium.

While the subject invention has been described with respect to a composite bearing structure which includes a steel substrate and a bearing layer of aluminum or aluminum alloy, it is to be noted that bearings consisting of aluminum or aluminum alloys only can be plated by the technique of the invention. So-coated bearings are resistant to corrosion and have an enhanced physical appearance. A typical example showing the coating of an aluminum base bearing is set forth below.

EXAMPLE 5

An aluminum alloy bearing composed of 85% aluminum, 4% silicon, 8.5% lead, 1.5% tin and 1.0% copper was coated with tin as follows:

(a) vapor degreasing with perchloroethylene;

(b) alkaline soak cleaned in an aqueous solution of 20 g/l $Na_3PO_4$ plus 20 g/l $Na_2CO_3$, for about 2 minutes;

(c) water rinse;

(d) soaked in an aqueous solution of 10% sulfuric acid at a temperature of 150° F. for about 3 minutes;

(e) water rinsed;

(f) soaked for a period of 0.5 minutes in an aqueous solution of 5% hydrofluoric acid;

(g) water rinsed;

(h) immersed for 3 minutes in a plating bath which contained 50–85 g/l sulfuric acid, 3–5 g/l fluoboric acid, 15–25 g/l stannous sulfate (8–13 g/l stannous tin), 3–5 g/l hydroquinone, and 1–2 g/l wetting agent (IGEPAL CO-880, TM of GAF Corp.);

(i) water rinsed;

(j) immersed in an aqueous solution of about 0.25 g/l of $Na_2Cr_2O_7$ at a temperature of about 170° F. for 0.5 minutes; and (k) removed therefrom and dried.

As used herein and in the appended claims the term "aluminum base metal" shall include aluminum and alloys of aluminum which contain at least 51% aluminum; the term ferrous base metal shall include iron or steel or alloys thereof which contain at least 51% iron; the term "tin base metal" shall include tin and alloys of tin.

While there have been described herein what are at present considered to be the preferred embodiments of this invention, it will be apparent to those skilled in the art that various changes and modifications may be made therein without departing from the spirit and scope of the invention, and it is, therefore intended in the appended claims to cover all such changes and modifications as fall within the true spirit and scope of the invention.

We claim:

1. A method of concurrently coating the surface of a composite bearing structure having one portion of the surface area thereof composed of an aluminum base metal and another portion of the surface area thereof composed of a ferrous base metal with an adherent layer of tin base metal, comprising:

contacting said composite structure with a mineral acid containing ions selected from the group consisting of fluoride ions, fluoride containing ions or mixtures thereof to activate the surface of said aluminum base metal; and immersing said composite structure in an aqueous plating bath containing a mineral acid, a source of ions selected from the group consisting of fluoride ions, fluoride containing ions or mixtures thereof and a source of stannous ions with said stannous ions being present in an amount ranging from about 1 to about 75 grams per liter, for a period of time sufficient to cause tin to be deposited concurrently on said aluminum base metal surface by the exchange of aluminum ions for tin ions and on said ferrous base metal surface by means of a galvanic couple formed between said aluminum base metal and said ferrous base metal.

2. The method of claim 1 wherein said mineral acid is selected from the group consisting of hydrofluoric acid, fluoboric acid and mixtures thereof.

3. The method of claim 1 wherein said stannous ions are present in an amount ranging from about 1 to about 35 g/l.

4. The method of claim 1 wherein said aqueous plating bath contains:

0–85 g/l sulfuric acid,

3–90 g/l fluoboric acid,

8–13 g/l stannous tin, and

3–5 g/l hydroquinone.

5. The method of claim 4 wherein said aqueous bath is also provided with 1–2 g/l of a wetting agent.

6. The method of claim 1 wherein said bath is also provided with at least about 1 g/l of zinc ions.

7. The method of claim 1 wherein said aqueous bath is also provided with at least about 1 g/l of lead ions.

8. The method of claim 1 wherein said bath is also provided with at least about 0.1 g/l of cadmium ions.

9. The method of claim 6 wherein said aqueous plating bath has a pH of greater than about 2.5 and includes:
0 to 88 g/l sulfuric acid,
3 to 200 ml/l fluoboric acid,
0 to 8 g/l hydroquinone,
1.7 to 120 g/l sodium gluconate,
1 to 75 g/l stannous ions, and
1 to 75 g/l zinc oxide.

10. The method of claim 9 wherein said bath also contains up to about 4 g/l of a surfactant.

11. the method of claim 7 wherein said aqueous plating bath includes:
3 to 200 g/l fluoboric acid,
1 to 75 g/l stannous ions,
0 to 8 g/l hydroquinone, and
1 to 75 g/l lead ions.

12. The method of claim 11 wherein said bath also contains up to about 4 g/l of a surfactant.

13. The method of claim 8 wherein said aqueous plating bath includes:
0–85 g/l sulfuric acid,
3–90 g/l fluoboric acid,
0–8 g/l hydroquinone,
1–75 g/l stannous ions, and
0.1–75 g/l cadmium ions.

14. The method of claim 1 wherein prior to contacting the composite structure with a source of fluoride ions, fluoride containing ions or mixtures thereof said structure is contacted with an acid to clean the ferrous base metal surface.

15. A composite bearing having a substrate composed of a ferrous base metal with a bearing layer of aluminum base metal being carried thereon with the entire surface of said composite bearing being coated with a thin, adherent layer of tin base metal according to the method of claim 1.

* * * * *